US005376943A

United States Patent [19]

Blunden et al.

[11] Patent Number: 5,376,943

[45] Date of Patent: Dec. 27, 1994

[54] MOVING VEHICLE TRANSPONDER

[75] Inventors: Peter P. Blunden; David A. Williams, both of Lincolnshire, England

[73] Assignee: Plessey SemiConductors Limited, Wiltshire, United Kingdom

[21] Appl. No.: 87,167

[22] Filed: Jul. 2, 1993

Related U.S. Application Data

[63] Continuation-in-part of Ser. No. 754,525, Sep. 4, 1991, abandoned.

[30] Foreign Application Priority Data

Sep. 7, 1990 [GB] United Kingdom ..... 9019645

[51] Int. Cl.[5] ..... H01Q 9/28

[52] U.S. Cl. ..... 343/795; 343/767; 343/702

[58] Field of Search ..... 343/795, 767, 702, 793, 343/794, 822, 851; H01Q 9/28

[56] References Cited

U.S. PATENT DOCUMENTS 3,845,490 10/1974 Manwarren et al. ..... 343/821
3,925,774 12/1975 Amlung ..... 343/795
4,068,232 1/1978 Meyers et al. ..... 342/44
4,104,630 8/1978 Chasek ..... 342/44

FOREIGN PATENT DOCUMENTS 0323011 7/1989 European Pat. Off. .
1348478 3/1974 United Kingdom ..... H01Q 9/16

*Primary Examiner*—Donald Hajec
*Assistant Examiner*—Hoanganh Le
*Attorney, Agent, or Firm*—Kirschstein, Ottinger, Israel & Schiffmiller

[57] ABSTRACT

A transponder tag operative in the UHF range and including a substrate of dielectric material having formed on one side a conductive surface providing a ground plane and a dipole antenna, a slot line within the ground plane forming a balanced antenna feeder and leading to the center of the dipole antenna, and the substrate having mounted on the side of the substrate opposite to the one side a transmission line feeder positioned for electromagnetic coupling with the slot line, the transmission line feeder being coupled to transceiver circuit and processing circuit mounted on the opposite side for performing a transponding function.

4 Claims, 3 Drawing Sheets

DETAIL OF TRANSPONDING TAG ANTENNA COUPLER

Fig. 1. TRANSPONDING TAG BLOCK DIAGRAM

Fig. 2. TRANSPONDING TAG CIRCUIT DIAGRAM

DETAIL OF TRANSPONDING TAG ANTENNA COUPLER

MOVING VEHICLE TRANSPONDER

This application is a continuation in part of application Ser. No. 07/754,525 dated Sep. 4, 1991, now abandoned.

FIELD OF THE INVENTION

This invention relates to transponder tags, particularly though not exclusively for attaching to vehicles.

BACKGROUND ART

A system has been devised which allows road toll fees to be collected automatically, the system comprising an interrogator device buried in the carriageway and transponder tags fitted to vehicles.

When a suitably equipped vehicle approaches a toll point its presence is detected by an inductive loop detector (similar to that used at traffic lights) and the interrogator is energised. The interrogator transmits to the vehicle a signal at 915 MHz carrying a code which is recognised by the vehicle tag as a command to turn on its transmitter. The tag transmitter then sends a coded signal identifying the vehicle registration number to the interrogator in the carriageway. It is therefore possible to collect toll fees for tag-equipped vehicles without the need for manned toll booths and without the need for the vehicles to slow down so that money could be transferred.

It will be understood that for the purposes of this specification, "transponder tag" is intended to mean a unitary device which includes elements necessary for this operation in receiving radiated signals and transmitting signals in response thereto.

SUMMARY OF THE INVENTION

It is an object of the present invention to provide a transponder tag which is of a particularly simple, inexpensive and reliable construction.

The present invention is intended to operate in the UHF range, and specifically at 915 MHz. However, for the purpose of this specification "UHF range" is intended to mean any frequency below 2 GHz and including frequencies which would normally be regarded as microwave.

In a first aspect the present invention provides a transponder tag operable in the UHF range of frequencies comprising:

a substract of dielectric material having first and second sides;

a first conductive coating formed on said first side of said substrate to provide a dipole antenna and a ground plane and to define a slot line within the ground plane forming a balanced antenna feeder leading to the centre of said dipole antenna;

a second conductive coating on said second side of said substrate forming a pattern of conductors opposite said ground plane; and transceiver circuit means and signal processing circuit means mounted on said second side of said substrate, said pattern of conductors providing circuit interconnections of said transceiver circuit means and said signal processing circuit means, and providing a transmission line electromagnetically coupling said transceiver circuit means to said slot line;

said transceiver circuit means including means to demodulate a received UHF signal and said signal processing circuit means including means to provide data characterising said transponder tag for transmission by said transceiver means by way of said dipole antenna.

In accordance with a second aspect the invention provides a transponder tag operable in the UHF range of frequencies comprising:

a substrate of dielectric material having first and second sides;

a first conductive coating formed on said first side of said substrate to provide a dipole antenna and a ground plane and to define a slot line within the ground plane forming a balanced antenna feeder leading to the centre of said dipole antenna, the ground plane extending adjacent said dipole antenna substantially the full length of said antenna at a maximum separation from said antenna of between one fortieth and one eighth of a wavelength at the frequency of operation of the transponder tag;

a second conductive coating on said second side of said substrate forming a pattern of conductors opposite said ground plane; and transceiver circuit means and signal processing circuit means mounted on said second side of said substrate, said pattern of conductors providing circuit interconnections of said transceiver circuit means and said signal processing circuit means, and providing a transmission line electromagnetically coupling said transceiver circuit means to said slot line.

As preferred the dipole antenna is formed by removing for example by etching selected parts of said conductive surface, leaving a strip defining a dipole antenna which is connected to the ground plane at the central region of the strip. The transmission line feeder may comprise a conductive strip, $\lambda/4$ long terminating at a position generally opposite the slot line for maximum coupling to the slot line.

The transceiver means comprises an oscillator coupled via a buffer (power) amplifier to the transmission line feeder, the collector of an RF transistor of the amplifier being directly coupled to the feeder. The oscillator and amplifier are CW modulated by switching of the power supplied to the oscillator and amplifier by means of output data signals from the processor.

BRIEF DESCRIPTION OF THE DRAWINGS

A transponder tag in accordance with the present invention will now be described with reference to the accompanying drawings, of which.

DESCRIPTION OF THE PREFERRED EMBODIMENT

Figure 1:
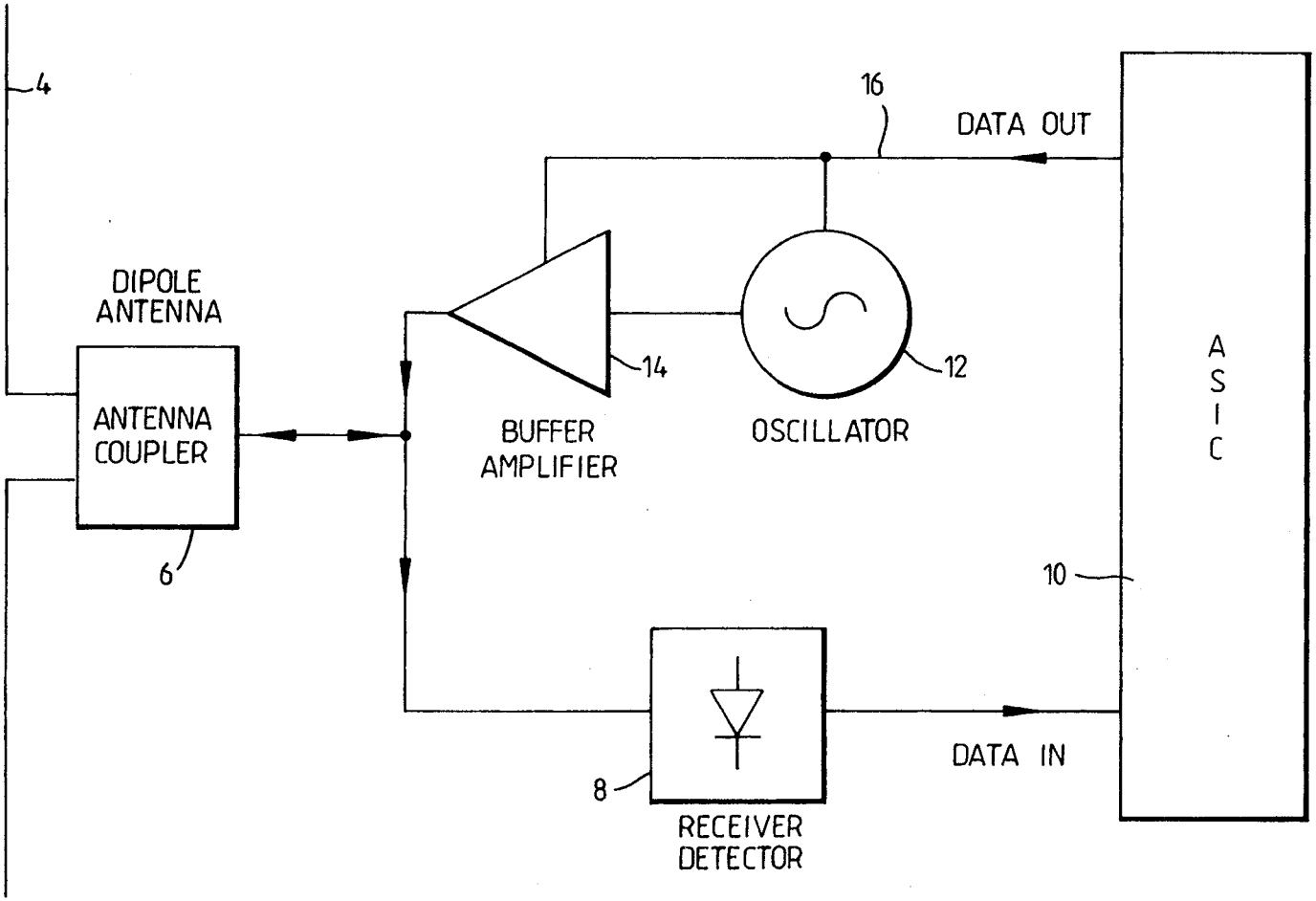
FIG. 1 is a block diagram of the transponder tag.

Referring now to the drawings FIG. 1 shows a dipole antenna 2 which is coupled via an antenna coupler 6 to a receiver/detector 8 which demodulates data received by the antenna and passes the demodulated data to a data processor 10 formed as an application-specific integrated circuit, or ASIC. Output data provided by the processor 10 is coupled to an RF oscillator 12 which oscillates a 915 MHz and to a buffer (power) amplifier 14 which amplifies the oscillator signals and feeds the signals to antenna coupler 6. The data on output line 16 from processor 10 modulates the output of the oscillator and buffer amplifier in a CW modulation mode, both the oscillator and amplifier being switched on and off directly by the output data.

Figure 3:
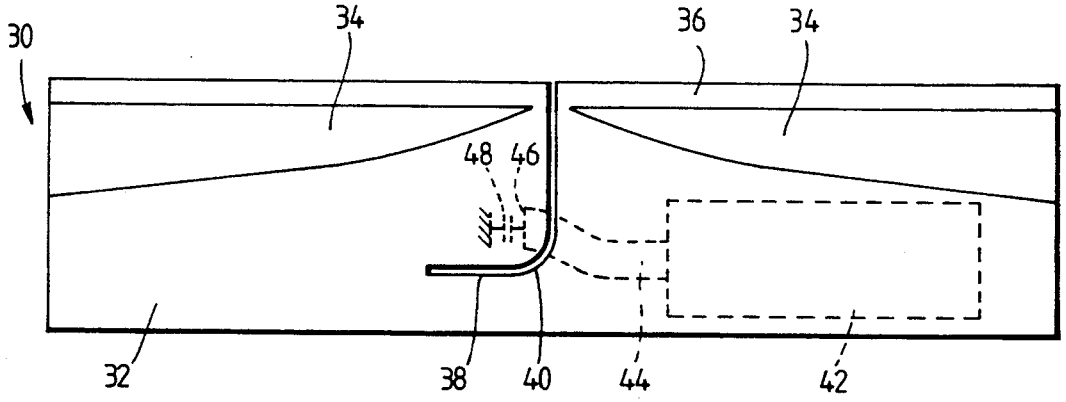
FIG. 3 is a plan view of the transponder tag showing the antenna and antenna feed arrangement.

Referring to FIG. 3, the transponder tag is formed on a substrate 30 of epoxy resin impregnated glass fibre board approximately 1.6 mm thick, 143 mm long and 37 mm wide, having a dielectric constant of the order of 4.7 and having on one major face a conductive layer 32 (for example copper). The layer 32 forms a ground plane, and portions of the layer 32 are removed as at 34 to define along one long edge of the substrate a dipole antenna strip 36 having an input impedance of 75 ohms at its centre. A slot line 38 is formed in the ground plane extending from the mid point of the antenna 36 and forming a right angled bend as at 40. On the other side of the substrate 30, as indicated in dotted lines, the electrical components indicated in FIG. 1 are mounted as at 42, preferably by means of surface mount technology on an array of solder bumps. The electronic components 42 are coupled to the antenna by means of a microstrip transmission line 44, formed as a strip of conductive metal coated on substrate 30 and having a length of approximately $\lambda/4$ with the free end of the strip 46 terminating close to a position directly opposite slot line 38. The end 46 of the line 44 is coupled via a capacitive coupling 48 through to the ground plane. This arrangement provides electromagnetic coupling between the line 44 and the slot line 38, energy being coupled to the slot line 38 and then being conducted in a balanced feed arrangement on either side of the slot line to the dipole antenna to provide a balanced feed to the dipole antenna.

Figure 2:
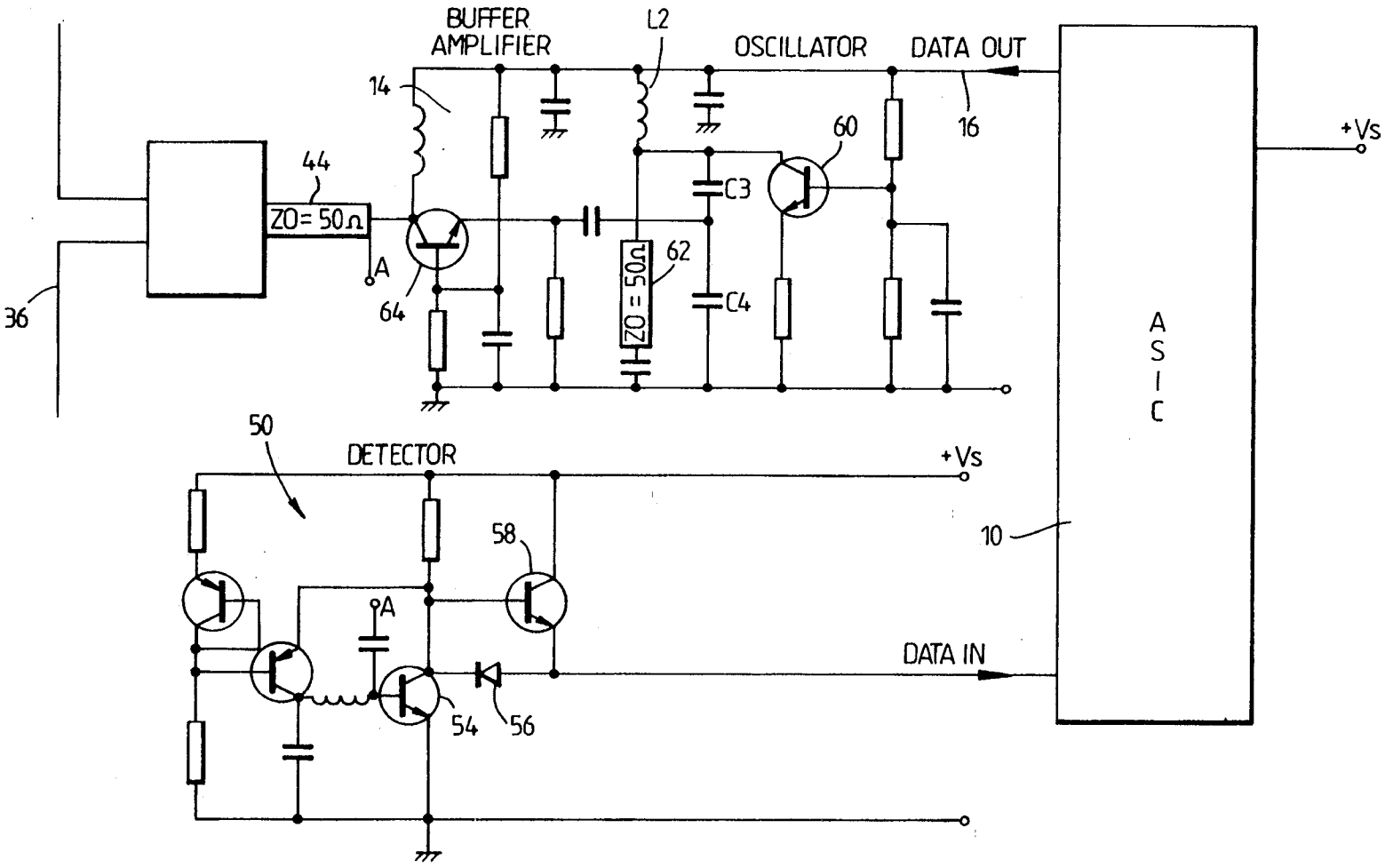
FIG. 2 is a circuit diagram of part of the transponder tag of FIG. 1.

Referring now to FIG. 2, this shows a circuit diagram of the transceiver arrangement, which comprises a receiver or detector 50 coupled to transmission line 44 via a capacitor 52, the base of an RF detector transistor 54 being directly coupled to capacitor 52. The collector of transistor 54 is coupled to the base and, via a diode 56, to the emitter of a further transistor 58. A tuning circuit for the detector includes the transmission line 44, while transistors 65, 66, capacitor C1 and inductor L1 provide active bias for the detector transistor 54. The combination of transistor 54, diode 56 and transistor 58 provide a means of demodulating the data from the input RF signal, and the demodulated data is fed to processor 10. Processor 10 responds to the input data by providing data characterising the transponder tag on output line 16, for modulation of an oscillator 12 comprising a transistor 60 and a resonant circuit arrangement L2, C3, C4, the frequency of oscillation being determined by a micro strip 62 or by a ceramic resonator element (not shown). The oscillator is coupled to buffer amplifier 14 comprising an RF transistor 64 coupled in common base mode to oscillator 12 and having its collector directly coupled to the transmission line 44.

Referring again to FIG. 3, the dipole antenna 36 comprises a strip of the conductive layer 32 some 3 mm wide extending along one long edge of the substrate 30, with the slot line 38 dividing it at its centre. From a few millimetres either side of the slot line 38 the forward edge of the ground plane diverges progressively from the rear edge of the antenna 36 along a curve which approximates to part of a secant squared curve, being separated from the antenna at the tips of the dipole by some 12 mm. This small separation, of the order of one twentieth of a wavelength at the frequency of operation of the tag, provides a usable area of ground plane and substrate for the electronic components 42 within the confines of a small board, without too much affecting the performance of the antenna 36. It is found that with the dimensions given a gain of some 3 dB is obtained in the forward direction of propagation compared with the rearward direction, without appreciable distortion of the radiation pattern of the antenna, and it is envisaged that acceptable board utilisation and antenna radiation performance would be available for maximum separation between antenna and ground plane in the range from one fortieth to one eighth of a wavelength at the frequency of operation of the tag.

The processor circuit 10 is powered by a lithium battery (not shown) and the battery and transponder tag are housed in an overall plastics encapsulation.

We claim:

1. A transponder tag operable in the UHF range of frequencies comprising:

a substrate of dielectric material having first and second sides;

a first conductive coating formed on said first side of said substrate to provide a dipole antenna and a ground plane and to define a slot line within the ground plane forming a balanced antenna feeder leading to the centre of said dipole antenna;

a second conductive coating on said second side of said substrate forming a pattern of conductors opposite said ground plane; and receiver circuit means, signal processing circuit means and transmitter circuit means mounted on said second side of said substrate, said pattern of conductors providing circuit interconnections between said receiver circuit means and said signal processing circuit means, and between said signal processing circuit means and said transmitter circuit means, and providing a transmission line electromagnetically coupling said receiver and transmitter circuit means to said slot line;

said receiver circuit means including means to demodulate a received UHF signal and said signal processing circuit means including means to provide data characterizing said transponder tag for transmission by said transmitter circuit means by way of said dipole antenna.

2. A transponder tag according to claim 1 wherein the transmitter circuit means comprises an oscillator circuit and an output amplifier and means to switch said oscillator circuit and said amplifier on and off together in dependence upon said data provided by said signal processing circuit means.

3. A transponder tag operable in the UHF range of frequencies comprising:

a substrate of dielectric material having first and second sides;

a first conductive coating formed on said first side of said substrate to provide a dipole antenna and a ground plane and to define a slot line within the ground plane forming a balanced antenna feeder leading to the centre of said dipole antenna, the ground plane extending adjacent said dipole antenna substantially the full length of said antenna at a maximum separation from said antenna of between one fortieth and one eighth of a wavelength at the frequency of operation of the transponder tag;

a second conductive coating on said second side of said substrate forming a pattern of conductors opposite said ground plane; and receiver circuit means, signal processing circuit means and transmitter circuit means mounted on said second side of said substrate, said pattern of conductors providing circuit interconnections between said receiver and transmitter circuit means and said signal processing circuit means, and providing a transmission line electromagnetically coupling said receiver and transmitter circuit means to said slot line.

4. A transponder tag according to claim 3 wherein the ground plane is connected to the dipole antenna at the centre thereof on either side of the slot and diverges from said antenna outwardly of said centre in accordance with a secant squared law.

* * * * *